United States Patent [19]

Vieau et al.

[11] Patent Number: 4,693,039

[45] Date of Patent: Sep. 15, 1987

[54] GRINDING HEAD ASSEMBLY

[75] Inventors: Robert G. Vieau, Plymouth; William D. Klempke, Brooklyn Park, both of Minn.

[73] Assignee: Loram Maintenance of Way, Inc., Hamel, Minn.

[21] Appl. No.: 871,170

[22] Filed: Jun. 3, 1986

Related U.S. Application Data

[63] Continuation of Ser. No. 696,753, Jan. 31, 1985, abandoned.

[51] Int. Cl.[4] ..... B24B 41/00

[52] U.S. Cl. ..... 51/168; 51/178

[58] Field of Search ..... 51/178, 209 R, 168, 51/71, 72 R, 166 R, 166 TS

[56] References Cited

U.S. PATENT DOCUMENTS

| | | | |
|---|---|---|---|
| 1,832,515 | 11/1931 | Webster | 51/209 R |
| 1,856,321 | 5/1932 | Doermann | 51/209 R |
| 1,984,050 | 12/1934 | Beebe | 51/209 R |
| 2,108,630 | 2/1938 | Walker | 51/209 R |
| 2,110,619 | 3/1938 | Beth | 51/209 R |
| 2,246,223 | 6/1941 | Shue | 51/209 R |
| 2,720,733 | 10/1955 | Ballash | 51/209 R |
| 2,799,980 | 7/1957 | Keeleric | 51/209 R |
| 3,866,361 | 2/1975 | Mauck | 51/358 |

FOREIGN PATENT DOCUMENTS

| | | | |
|---|---|---|---|
| 512530 | 10/1928 | Fed. Rep. of Germany | 51/209 S |
| 1107254 | 8/1955 | France | 51/209 R |

*Primary Examiner*—Frederick R. Schmidt
*Assistant Examiner*—Bradley I. Vaught
*Attorney, Agent, or Firm*—Dorsey & Whitney

[57] ABSTRACT

A grinding head assembly especially designed for heavy duty grinding applications, such as maintenance of railroad track rails, is disclosed. The grinding head assembly hereof broadly includes an abrasive grinding stone, a backing plate for the stone having a plurality of attachment bosses, and a backing plate holder having a plurality of complementary boss-receiving cavities. The grinding head assembly disclosed herein provides for fast and easy replacement of grinding stones, and is designed to transmit large quantities of power.

9 Claims, 5 Drawing Figures

GRINDING HEAD ASSEMBLY

This application is a continuation of copending application Ser. No. 696,753 filed Jan. 3, 1985 now abandoned.

TECHNICAL FIELD

This invention relates to grinding head assemblies. In particular, it relates to a grinding stone backing plate for mounting a heavy duty, grinding stone to a rotatable mount for the stone.

BACKGROUND OF THE INVENTION

Routine maintenance of railroad tracks includes grinding the surface of the rail to remove corrugations to restore a smooth, regular travel surface. Corrugations result from prolonged passage of rail cars over the rails, especially at curves. Corrugations also regularly appear in the vicinity of defective rail joints.

Maintenance of the rails, to remove corrugations, comprises the process of passing a grinding machine, which has longitudinally spaced multiple grinding heads, over each rail. Each grinding machine has a grinding stone attached to a grinding stone holder. The holder is attached to a vertically disposed rotatable drive shaft which is driven by a motor. The grinding head is lowered until the plane surface of the grinding wheel is in contact with the surface of the rail. The head is rotated, creating a grinding motion on the surface of the rail, and the machine is moved along the railroad track to continuously grind lengths of the rail surface as the grinding head passes over it.

The abrasive grinding stones of rail grinding head assemblies are quickly worn down, and must be frequently replaced during on-site operations. Moreover, the grinding wheels are operated at approximately 3600 revolutions per minute, and must transmit sigificant amounts of power to the ground surface. It is also important, due to the high rotational speed of the grinding heads, that the component parts of the grinding head assembly be balanced.

The ideal grinding head assembly would be one that includes an easily accessible attachment means for connecting a disposable grinding stone to the assembly, which is inherently self-centered upon installation, and which is capable of transmitting significant amounts of power to the track rail being ground.

SUMMARY OF THE INVENTION

The criteria outlined above are in large measure met by the improved grinding head assembly in accordance with the present invention. That is to say, the grinding head assembly hereof provides for fast and easy installation of grinding stones to the grinding head assembly, thereby shortening down time during on-site operations, is inherently self-centered upon installation, and is designed to transmit large quantities of power to the track rail being ground. The grinding head assembly in accordance with the present invention broadly includes an abrasive grinding stone, a backing plate for the grinding stone, and a backing plate holder for connecting the grinding stone and backing plate to a rotatable shaft. The grinding stone backing plate includes a plurality of upwardly extending bosses that are received in complementary cavities on the backing plate holder. Attachment means are received through the backing plate holder cavities and backing plate bosses for secure attachment of the backing plate to the backing plate holder.

DETAILED DESCRIPTION OF THE DRAWINGS

Figure 1:
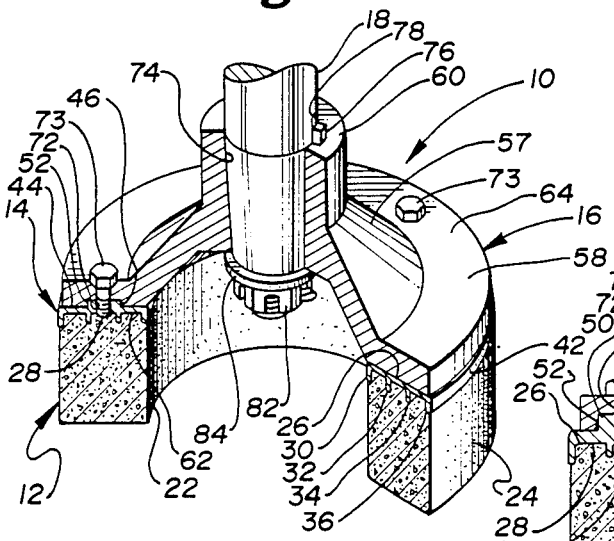
FIG. 1 is a fragmentary, perspective view of an improved grinding head assembly in accordance with the present invention.
Figure 2:
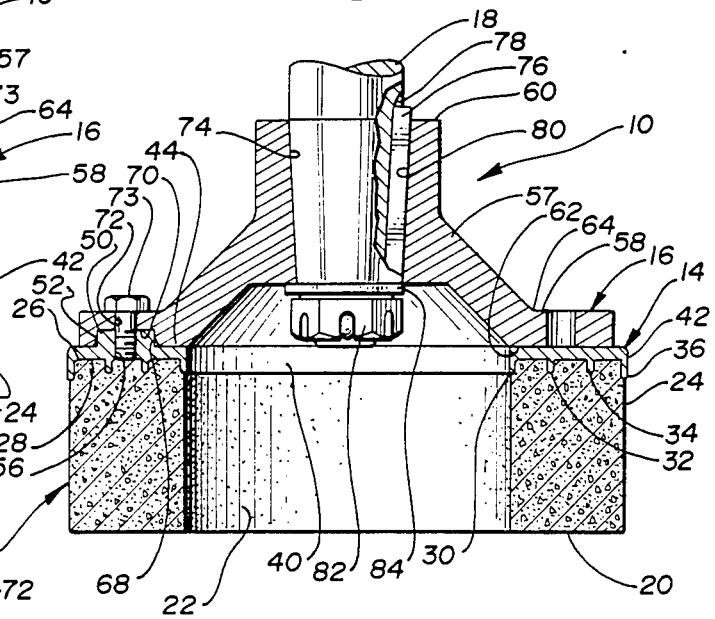
FIG. 2 is a side elevational cross section view of the improved grinding head assembly, with the motor shaft cut away to show the shaft key and keyways.
Figure 3:
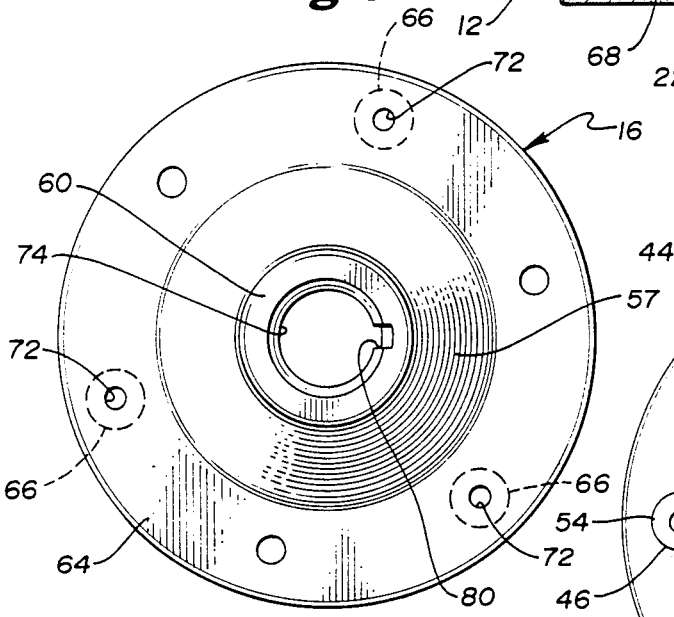
FIG. 3 is a plan view of the grinding head assembly.
Figure 4:
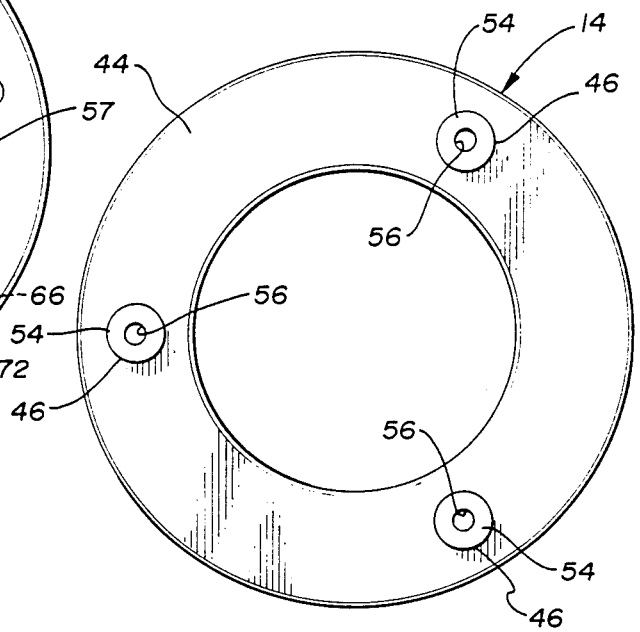
FIG. 4 is a plan view of the backing plate holder of the grinding head assembly.

Referring to the drawings, the present invention broadly includes a grinding stone 12, a backing plate 14, and a backing plate holder 16. The backing plate holder 16 is detachably secured to motor shaft 18 for rotation therewith.

The grinding stone 12 comprises a tubular shaped, molded abrasive material. The stone 12 has an annularly shaped grinding surface 20, and cylindrically shaped inner and outer sidewalls 22, 24. The top wall 26 of stone 12 is fixedly attached to backing plate 14 by bonding the abrasive material that forms the stone to the backing plate upon pressure, by use of a suitable adhesive, or by other suitable attachment means.

Figure 5:
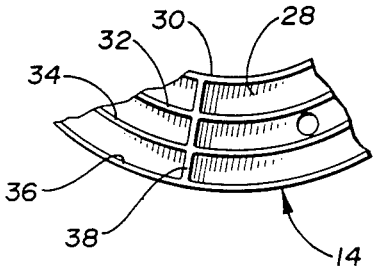
FIG. 5 is a fragmentary, bottom view of the backing plate holder.

The backing plate 14 comprises an annular, preferably aluminum, metal ring. The bottom, stone abutting surface 28 of the backing plate holder includes a plurality of downwardly projecting, concentric, circular ribs 30, 32, 34, 36. The bottom surface 28 also includes generally equally angularly spaced apart, radially extending ribs, one of such ribs 38 being depicted in FIG. 5. The innermost and outermost circular ribs 30, 36 comprise extensions of the backing plate's inner and outer sidewalls 40, 42. Circular rib 36 extends downwardly further than ribs 30, 32, 34, giving the backing plate outer surface 42 greater depth than the inner surface 40. The portions of backing plate holder bottom wall 28 interposed between ribs 30, 32, 34, 36 collectively define a generally planar attachment surface for stone 12.

The backing plate top wall 44 comprises an annular, generally planar surface. A plurality of generally cylindrical bosses 46 extend upwardly from the backing plate top wall surface 44. The bosses 46 each include a cylindrical sidewall 52, and a generally flat or planar, annular front wall 54. Each of the bosses 46 include centered, threaded, axially extending channels 56 that extend through the boss and open through to the backing plate bottom wall 28.

Backing plate holder 16 includes frusto-conical midportion 57, radially projecting backing plate attachment flange 58, and backing plate extending sleeve 60. Attachment flange 58 includes generally flat, annular backing plate holder receiving lower surface 62, and upper surface 64. Backing plate holder lower surface 62 includes cylindrically shaped, boss-receiving cavities 66. Each cavity 66 includes a generally cylindrical sidewall 68, and a generally flat annular top wall 70. Centered, bored-through channels 72 extend upwardly from each boss-receiving cavity 66, opening to the backing plate holder upper surface 64. A threaded bolt 73 is received through each cavity channel 72 and threaded boss channels 56.

Upwardly extending sleeve 60 includes internal, centrally located, drive shaft-receiving frusto-conical bore 74. Drive shaft 18 is received within bore 74, and is held in radially fixed position relative to the bore 74 by key 76. Key 76 is received in shaft keyway 78 and sleeve keyway 80. Nut 82, and washer 84 hold shaft 18 in fixed axial position relative to sleeve 60.

In operation, backing plate holder 16 is attachably coupled to drive shaft 18 for rotation therewith by key 76 and nut 82. The backing plate holder 16 is not normally detached from the shaft 18 during on-site operations.

The grinding stone 12 and stone backing plate 14 are manufactured as a single component for the grinding head assembly. The stone 12 is worn away during grinding operations, and must be replaced when the grinding surface 20 of the stone 12 comes into close proximity with the backing plate holder ribs 30, 32, 34, 36, 38.

The backing plate holder 16 is especially designed to facilitate fast replacement of the grinding stone 12 during on-site operations. In particular, removal of a worn stone is accomplished by removing bolts 73, thereby detaching the backing plate 14, with its associated stone 12, from the backing plate holder 16. A new backing plate, with an unworn grinding stone is then fitted to the backing plate holder 16. The bosses 46 of the backing plate are received within the cavities 66 of the backing plate holder, thereby centering the stone 12 and backing plate 14 about the drive shaft 18, and positioning the backing plate boss threaded channels 56 with the backing plate holder channels 72. Bolts 73 are then inserted through the backing plate holder channels 72, and threadably received within the backing plate boss threaded channels 56, for secure attachment of the backing plate 14 to the backing plate holder 16. The complementary fit of the bosses 46 within cavities 66, and the threadable attachment of bolts 73 through the backing plate holder to the backing plate, provide for the efficient transfer of rotatable motion from the backing plate holder 16 to the backing plate 14 and stone 12.

We claim:

1. A grinding head assembly, comprising:

an abrasive grinding element having a grinding surface and a generally annular opposed top surface;

a rigid, generally annular backing plate having a generally annular first surface operably coupled to and esentially covering said grinding element top surface, said first surface comprising an annular, generally planar face and a plurality of radially spaced concentric ribs projecting outwardly from said face and an opposed, second surface spaced apart from said first surface to define a backing plate width;

a generally cylindrical attachment boss projecting outwardly from said second surface and spaced apart from said grinding element by said backing plate width, said boss defining a boss diameter extending across at least two of said concentric ribs, and including structure defining an internally threaded boss channel;

a backing plate holder adapted to be drivingly connected for rotation with a drive shaft, said backing plate holder including an attachment surface including structure defining a cavity for receiving said boss in a complementary fit whereby the rotational energy of said backing plate holder is transferred to said boss and distributed along said rigid, generally annular backing plate, through said backing plate width, to said grinding element; and attachment means extending through said cavity and receivable in threaded engagement by said boss channel for detachably coupling said backing plate to said backing plate holder.

2. An assembly as claimed in claim 1, said backing plate second surface comprising a generally planar face having a plurality of outwardly projecting attachment bosses angularly spaced apart from each other along said face, said backing plate holder attachment surface comprising a generally planar face including structure defining a plurality of cavities for receiving said bosses in complementary fits.

3. An assembly as claimed in claim 2, said bosses and said cavities being generally equally angularly spaced apart along their respective surfaces.

4. An assembly as claimed in claim 1, said boss having an external cylindrical sidewall and planar top wall, said cavity including an internal cylindrical sidewall and planar top wall.

5. An assembly as claimed in claim 4, said boss top wall oriented generally perpendicular to said boss sidewall, and said cavity top wall oriented generally perpendicular to said cavity internal cylindrical sidewall.

6. An assembly as claimed in claim 5, said threaded boss channel oriented generally parallel with said boss sidewall and presenting a boss channel aperture opening generally centered on said boss top wall.

7. An assembly as claimed in claim 6, said backing plate holder including an attachment means support surface opposed to said attachment surface, and further including structure defining an attachment means receiving channel in communication with said cavity, said attachment means channel oriented generally parallel to said cavity sidewall and presenting a first attachment means aperture opening generally centered on said cavity bottom wall and a second attachment means aperture opening on said attachment means support surface.

8. An assembly as claimed in claim 7, said attachment means comprising a bolt having a threaded rod received through said attachment means channel and cavity and threadably received by said boss channel, and a head abutably engageable with said attachment means support surface.

9. An assembly as claimed in claim 1, said backing plate first surface planar face including a plurality of generally equally angularly spaced apart, radially extending ribs projecting outwardly from said face.

* * * * *